United States Patent [19]

Caputo

[11] Patent Number: 4,754,850

[45] Date of Patent: Jul. 5, 1988

[54] METHOD FOR PROVIDING A LOAD COMPENSATION SIGNAL FOR A TRACTION ELEVATOR SYSTEM

[75] Inventor: William R. Caputo, Wyckoff, N.J.

[73] Assignee: Westinghouse Electric Corp., Pittsburgh, Pa.

[21] Appl. No.: 102,069

[22] Filed: Jul. 29, 1987

[51] Int. Cl.[4] ..... B66B 1/28

[52] U.S. Cl. ..... 187/115

[58] Field of Search ..... 187/115

[56] References Cited

U.S. PATENT DOCUMENTS

| | | | |
|---|---|---|---|
| 3,244,957 | 4/1966 | Speiss et al. | 187/115 X |
| 3,486,101 | 12/1969 | Rufli | 187/115 X |
| 3,614,996 | 10/1971 | Saito et al. | 187/115 |
| 3,847,251 | 11/1974 | Maltby et al. | 187/115 |
| 4,042,068 | 8/1977 | Ostrander et al. | 187/115 |
| 4,553,640 | 11/1985 | Inaba et al. | 187/115 |

FOREIGN PATENT DOCUMENTS

| | | | |
|---|---|---|---|
| 53-4947 | 1/1978 | Japan | 187/115 |

*Primary Examiner*—William M. Shoop, Jr.
*Assistant Examiner*—W. E. Duncanson, Jr.
*Attorney, Agent, or Firm*—D. R. Lackey

[57] ABSTRACT

A method for providing a load compensation signal for the drive motor control loop of a traction elevator system which includes an elevator car, a counterweight, and a drive which includes a drive motor, brake, and traction drive sheave. The brake is mounted to provide an indication of the direction of unbalanced brake torque, with the method including the step of detecting unbalanced brake torque when the elevator car is stationary. A car load compensation signal is provided in response to the detecting step, with the compensation signal transferring the unbalanced torque from the brake to the drive motor, building up the motor current to provide motor torque sufficient to hold the car stationary while the brake torque is reduced to zero. The method then continues by using the motor current to provide car loading signals for use by the supervisory control portion of the elevator system.

7 Claims, 3 Drawing Sheets

METHOD FOR PROVIDING A LOAD COMPENSATION SIGNAL FOR A TRACTION ELEVATOR SYSTEM

TECHNICAL FIELD

The invention relates in general to traction elevator systems which include an elevator car and counterweight mounted for guided movement in the hatch of a building, and more specifically to a method for providing a load compensation signal for the motor control loop of a traction elevator system for aiding the starting of the elevator car.

BACKGROUND ART

The load in an elevator car of a traction elevator system has been used by the car and/or group supervisory control for such control strategy functions as controlling by-passing of hall calls, initiating system "down peak", initiating special floor features, such as convention floor strategy, and the like.

Unbalanced car load, ie., a load, or lack of load, which either causes the weight on the car side of the traction ropes to exceed the weight on the counterweight side, or vice versa, has been detected and used to improve car dynamics, such as for providing smoother car starts.

The drive related compensation signals, related to unbalanced load, and the supervisory signals, related to actual car load relative to rated car load, are usually independently obtained.

A common arrangement for obtaining drive related compensation signals includes resiliently mounting the drive brake, and obtaining a signal indicative of the direction of load unbalance, if any. Unbalanced brake torque, however, may indicate more than just passenger loading. For example, in some elevator installations, no compensation chains or cables are provided, even on relatively tall buildings, such as outside elevators on hotel walls. Thus, unbalanced torque reflects the unbalanced weight of the hoist cables, with the hoist cable weight compensation error being maximum at the travel limits of the elevator car. Even when compensation is provided for the weight of the hoist roping, compensation chains and cables are available in a limited number of sizes. Thus, the compensation for the hoist ropes and traveling cable will usually have an error, and the error changes with car location in the building hatch.

It would be desirable to be able to derive unbalanced load signals for the motor control loop, and passenger load signals for the supervisory control, from the unbalanced torque, if the passenger load signals can be accurately obtained, regardless of the amount of hoist cable compensation error, and regardless of car position in the associated building. Thus, car load weighting switches on the car, as well as the associated wiring, would be eliminated.

DISCLOSURE OF THE INVENTION

Briefly, the present invention relates to methods for enabling unbalanced brake torque to be translated into a load compensation signal for the motor control loop, to effect a faster and smoother start for the elevator car. The method also translates the unbalanced brake torque into an accurate car loading signal suitable for supervisory control purposes, by transferring unbalanced brake torque into motor current and motor torque, determining the magnitude of the motor armature current, and processing the motor armature current to obtain an accurate indication of car load. The processing step further includes the step of applying a correction factor relates to the hoist cable compensation error and car position.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
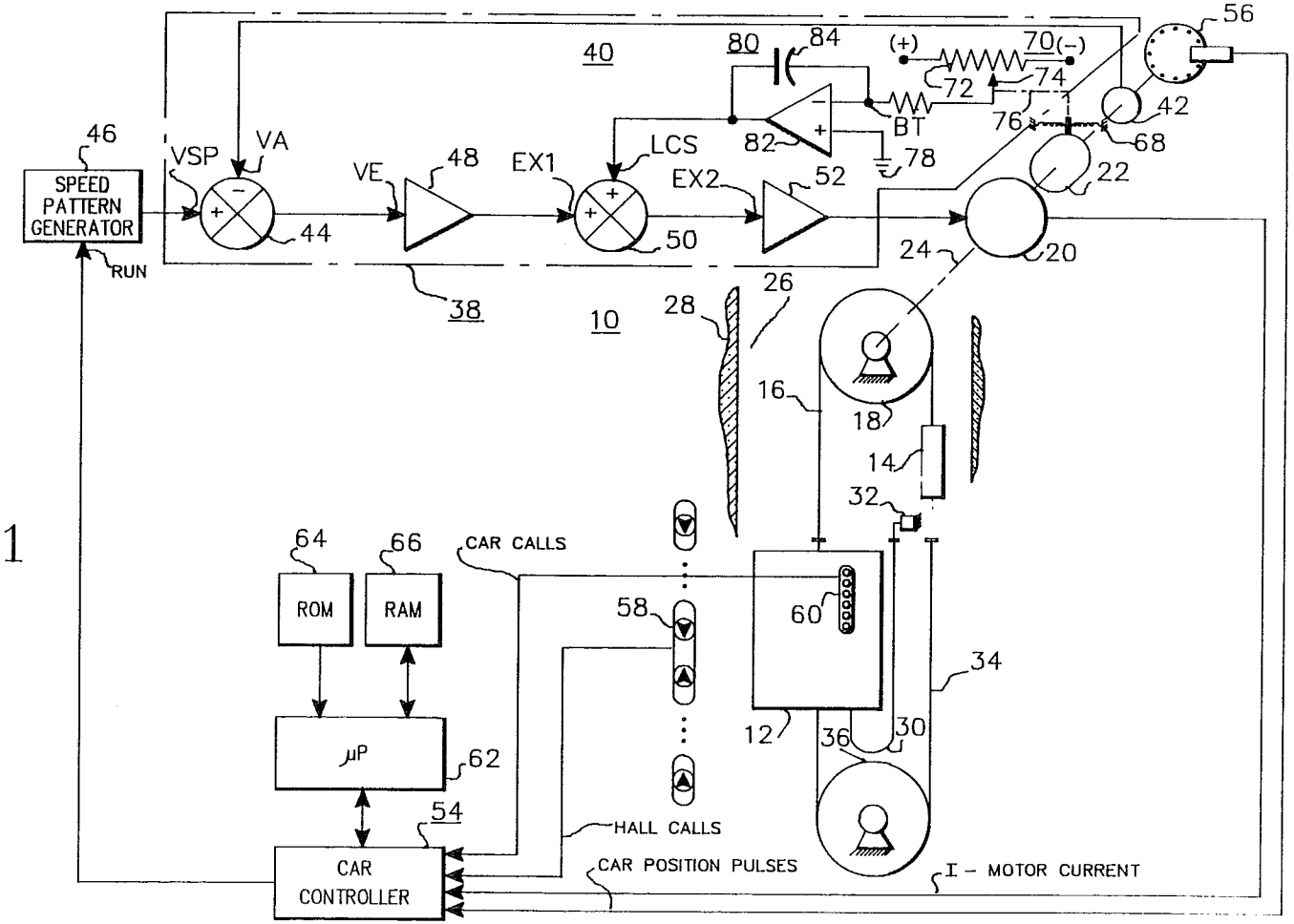
FIG. 1 is a diagrammatic representation of a traction elevator system which may be constructed and operated according to the teachings of the invention.

Referring now to the drawings, and to FIG. 1 in particular, there is shown a traction elevator system 10 which may be constructed and operated according to the teachings of the invention. Traction elevator system 10 includes an elevator car 12 connected to a counterweight 14 via a plurality of wire hoist ropes 16. Hoist ropes 16 are reeved about a traction drive sheave 18. The counterweight 14 is usually selected to provide a weight equal to the weight of car 12 plus 40% of rated car load. Drive sheave 18 is coupled, either directly or via suitable reduction gearing, to an AC or a DC drive motor 20. A brake 22, such as a drum or disc brake, is coupled to the motor drive shaft, which is represented by broken line 24. Elevator car 12 and counterweight 14 are mounted for guided vertical movement in the hatch 26 of a building 28 via suitable guide rails (now shown). A traveling cable 30 for bringing electrical power to the elevator car 12, as well as containing communication and control wiring, interconnects car 12 and a junction box 32 located at mid hatch. Compensation ropes 34, which may be in the form of chains, cables, and the like, depending upon car speed, for compensating for the weight of the hoist ropes 16, are reeved about a compensation sheave 36 and connected to the bottom of the elevator car 12 and the bottom of the counterweight 14.

Drive motor 20 is controlled by a motor controller 38 having a motor control feedback loop 40. The actual speed of the elevator car 12 is detected, such as by a tachometer 42 coupled to the drive motor 20. Tachometer 42 provides an actual speed signal VA, which is used as a feedback signal for a summing point 44. The desired speed of the elevator car 12 at any instant during a run of elevator car 12 is provided by a speed pattern generator 46, which provides a speed pattern signal VSP for summing point 44. Summing point 44 provides a signal VE equal to the error or difference between the actual speed VA and the desired speed VSP, and this signal is conditioned and amplified by processing function 48 to provide a current reference signal EX1 which represents the motor current which is required to cause the car speed to correctly track the speed pattern.

The current reference signal EX1 is added to a load compensation signal LCS at a summing point 50. Summing point 50 provides a car load compensated signal EX2 for an amplifying and processing function 52, which in turn controls the drive motor current, such as the armature current of a DC motor. At the start of a run of elevator car 12, signal LCS is used transfer the unbalanced brake torque to the drive motor 20 before brake 22 is released, ie., the drive motor 20 is pre-torqued in the proper direction to replace the brake torque in supporting the imbalance. When the brake torque is reduced to zero, the brake 22 can then be lifted and the car will remain stationary. The car will then start smoothly when the speed pattern generator signal VSP is applied to junction 44. The brake 22 may be "zero torqued" at a predetermined point during closure of the car doors, enabling the brake to be lifted and the speed pattern applied as seen as the doors are fully closed, to reduce floor-to-floor time.

Elevator car 12 includes a car or supervisory controller 54 which keeps track of car position in building 28, such as from car position pulses developed by a pulse wheel 56 coupled to the drive motor 20. controller 54 also keeps track of hall calls from a hall call system represented by hall call buttons 58, it keeps track of car calls from a car station 60, and it provides a signal RUN which initiates production of a speed pattern signal VSP by the speed pattern generator.

Controller 54 also receives a signal I responsive to the motor current, and, according to the teachings of the invention controller 54 processes the motor current signal I prior to a run of the elevator car 12 to obtain an indication of car load. Controller 54 may include a microprocessor 62 having a read-only memory (ROM) 64 and a random-access memory (RAM) 66 for implementing the motor current processing function, as will be hereinafter explained.

Brake 22 is resiliently mounted such that an unbalanced brake torque will rotate brake 22 slightly in one rotational direction or the other, depending upon whether the car 12 and its load exceeds the weight of the counterweight 14, or vice versa. The resilient mounting, such as cantilever springs along with positive stops disposed to limit the extent of the rotational movement, for example, is indicated in FIG. 1 at 68. A signal indicative of unbalanced brake torque, and its direction, may be obtained by coupling movement of the brake 22 to a potentiometer 70 having a resistive element 72 connected between positive and negative sources of unidirectional potential, and a wiper arm 74. A mechanical coupling between brake 22 and wiper arm 74, indicated by broken line 76, moves wiper arm 74 to provide a positive signal BT with respect to ground 78 when the unbalance is in one direction, and a negative signal BT when the unbalance is in the opposite direction. Wiper arm 74 is initially adjusted to provide a zero output with a load in car 12 which causes the car to exactly balance the counterweight 14. Of course, other arrangements may be used for obtaining an indication of unbalanced brake torque, and its direction, such as the use of two switches. One switch would be actuated to provide a positive signal when the brake rotates in one direction, and the other switch would be actuated to provide a negative signal when the brake rotates in the opposite direction.

Signal BT is applied to an integrator 80, which may include an operational amplifier 82 having its inverting input connected to receive signal BT, its non-inverting input connected to ground 78, and a capacitor 84 connected in the feedback loop. The output of operational amplifier 82 provides signal LCS.

Figure 2:
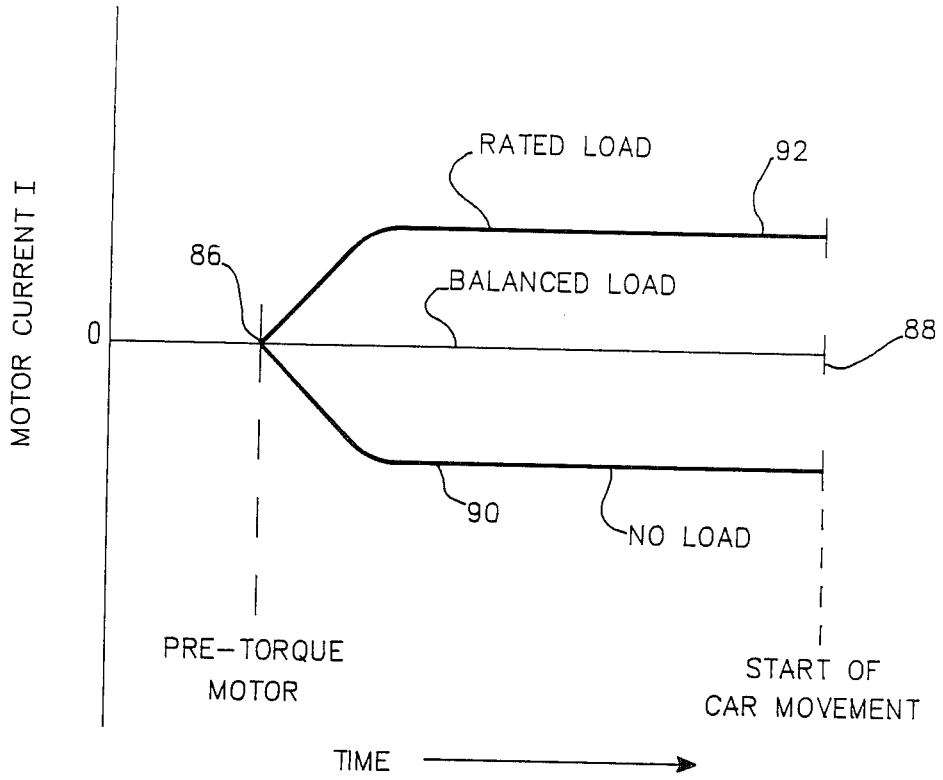
FIG. 2 illustrates motor armature current versus time during pre-torquing of the traction drive motor, for (1) no load in the elevator car, (2) a load in the elevator car which causes the car to balance the counterweight, and (3) with rated load in the elevator car.

FIG. 2 illustrates motor armature current from the time pre-torquing is initiated at point 86, to the time car movement is initiated at 88. With no load in elevator car 12, the counterweight 14 is heavier than the car. As the unbalanced brake torque is transferred to the drive motor 20, the motor current I increases to a steady value 90, in a predetermined first direction through the motor armature.

With a balanced load in elevator car 12, ie., a load which causes the elevator car 12 to exactly balance the weight of the counterweight 14, there is no unbalanced brake torque, and thus no motor current is developed as no motor torque is required to hold the car steady when the brake is released.

With car 12 loaded to rated capacity, the car 12 will be heavier than the counterweight 14. As the unbalanced brake torque is transferred to the drive motor 20, the motor current I increases to a steady value 92, in a direction through the motor armature which is opposite to the first direction. Car loads between no load and rated load will of course build up steady state current values between steady state values 90 and 92. The magnitude of the steady state value of the motor current I is detected by any suitable transducer, and the value is made available for the car controller 54 and its processing function 62.

Figure 3:
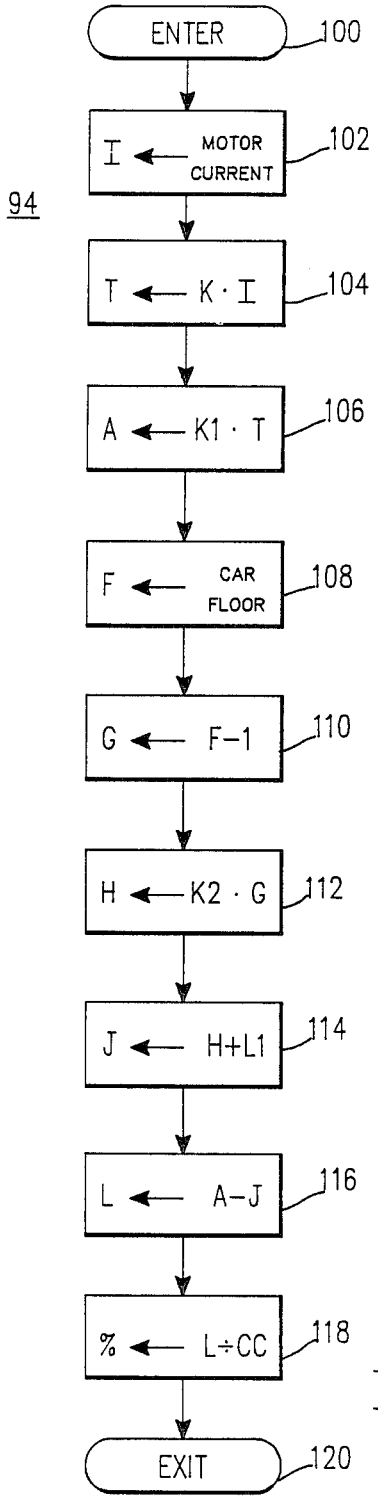
FIG. 3 is a flow chart illustrating the steps of a method for processing motor armature current into an accurate indication of car load, corrected for hoist rope compensation error and car position.
Figure 4:
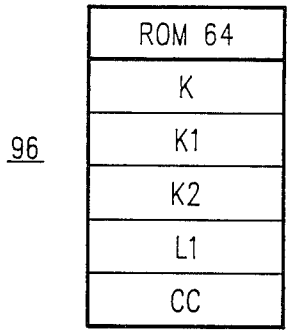
FIG. 4 is a ROM map illustrating constants which are used in a processing function of the invention.
Figure 5:
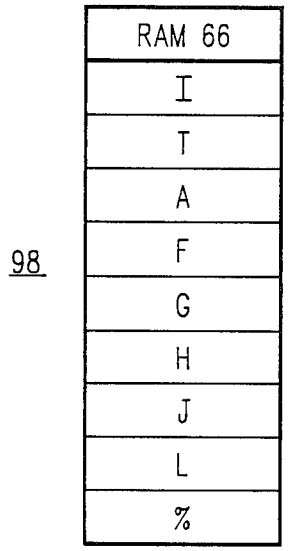
FIG. 5 is a RAM map illustrating variables which are stored at various times during the processing function of the invention.

Processing function 62 has a program 94 stored in ROM 64 for processing the motor current value into an accurate indication of car load, with FIG. 3 being a detailed flow chart of the transformation program 94. FIGS. 4 and 5 are ROM and RAM maps 96 and 98, respectively, of constants and variables used by, and stored by, the transformation program 94. Referring to the constants in ROM map 96, the constant K is used to transform the steady state value of motor current I into motor torque T, which is the same as the unbalanced brake torque before pre-torquing the motor 20. Torque T may alternatively determined by accessing a look-up table with the value of the motor current, which table would be specifically prepared for the motor 20 being used in the elevator system 10. Once the torque T is known, it is converted to difference in tension between the car side ropes and the counterweight side ropes of the hoist roping 16 by a constant K1. Constant K2 is determined from the error in hoist rope compensation. As hereinbefore stated, it is unusual when the weight of the traveling cable 30 and the weight of the compensation chain or cables 34 exactly compensate for the weight of the hoist cables. Also, as hereinbefore stated, some relatively high rise elevators do not have any compensation for the weight of the hoist ropes. K2 is equal to L2 minus L1 divided by one less than the number of floors in the bulding 28, where L1 is the error in compensation for the car 12 located at the bottom floor (positive for car side heavier than the counterweight side), and where L2 is the error in compensation for the car at the top floor (positive for car side heavier than the counterweight side). The constant CC is equal to the rated capacity of the elevator car 12.

Figure 6:
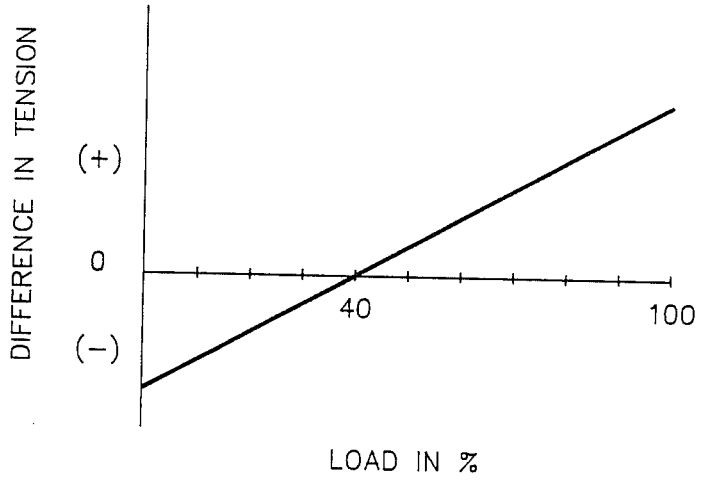
FIG. 6 is a graph which compares difference in tension between the hoist ropes on the car and counterweight sides of the drive sheave versus percent car load.

Program 94 is entered at 100 when car 12 is preparing to make a run, and the drive motor 20 has just been pre-torqued to reduce the unbalanced brake torque to zero. Step 102 reads the motor current I, and step 104 multiplies the value of current I by the constant K to obtain motor torque T required to hold the elevator car stationary. Step 106 multiplies torque T by the constant K1 to convert the unbalanced torque to difference in tension between the car and counterweight hoist cables 16, with the product being stored at A in RAM 66, as illustrated in the RAM map 98 shown in FIG. 5. FIG. 6 is a graph which illustrates how the difference in tension between the hoist ropes 16 on the car and counterweight sides of the drive sheave 18 is linearly responsive to the % of rated load in the elevator car.

A correction factor is then calculated according to the position of elevator car 12 in building 28, taking into consideration the error in compensating for the weight of the hoist ropes 16. The development of this correction factor includes a step 108 which reads the floor position of car 12 from a memory in car controller 54. Step 110 subtracts 1 from the floor position and stores the result at location G in RAM 66. Step 112 multiplies the value stored at location G by the constant K2 and stores the product at location H. Step 114 adds the value stored at location H and the constant L1 and stores the sum at location J. Step 116 subtracts the value stored at location J from the value stored at location A and stores the result at location L. The value stored at location L is the load in the car in pounds. Step 118 converts the load L into % load by dividing L by the car capacity CC obtained from ROM 64, and stores the result at location % in RAM 66. The value stored at location % is thus available for use by the supervisory strategy of the elevator car 12, as well as the supervisory strategy of a central dispatching system, when car 12 is part of a bank of cars under group supervisory control.

I claim as my invention:

1. A method for providing an unbalanced torque compensation signal for the current reference signal of a feedback control loop of an elevator drive motor of a traction elevator system which includes a brake, a drive sheave, an elevator car and counterweight interconnected via hoist cables reeved about the drive sheave and mounted for movement in the hatch of a bulding, and supervisory control for controlling the movement of the elevator car in response to calls for elevator service, comprising the steps of:

detecting unbalanced brake torque when the elevator car is stationary, providing a compensation signal for the current reference of the control loop in response to said detecting step, with said compensation signal initiating the step of transferring the unbalanced brake torque to motor current and motor torque prior to releasing the brake at the start of a run of the elevator car, to zero the brake torque, detecting the resulting motor current, and using the motor current to provide car loading signals for the car supervisory control.

2. the method of claim 1 wherein the traction elevator system includes compensating cables for compensating for the weight of the hoist cables, and wherein the step of using the motor current to provide car loading signals includes the step of compensating for car position and compensating cable error.

3. The method of claim 1 wherein the traction elevator system is devoid of compensating cables for compensating for the weight of the hoist cables, and wherein the step of using the motor current to provide car loading signals includes the step of compensating for car position and the lack of hoist cable compensation.

4. The method of claim 1 wherein the step of using the motor current to provide car loading signals includes the steps of:

determining the difference in tension between the hoist cables on the car and counterweight sides of the drive sheave, determining the compensation cable error for car location in the building, and subtracting the compensation cable error from the difference in tension to determine the load in the elevator car.

5. The method of claim 4 including the step of dividing the load in the car by the capacity of the elevator car, to determined the per cent load in the car.

6. The method of claim 4 wherein the step of determining the difference in tension includes the steps of providing a constant K1 which converts brake torque to difference in tension, determining the brake torque from the motor current, and multiplying the brake torque by the constant K1.

7. The method of claim 4 wherein the step of determining the compensation cable error includes the steps of determining the difference between the weight of the hoist cables and the weight of the compensation cables, determining compensation cable errors L1 and L2 from this weight difference when the elevator car is at the bottom and top floors, respectively, calculating a compensation cable error constant K2 for the building by the steps of subtracting L1 from L2 and dividing the result by one less than the number of floors in the building, multiplying K2 by one less than the actual floor location of the elevator car, and adding L1 to the product of the multiplication step.

* * * * *